US005778832A

United States Patent [19]

King et al.

[11] Patent Number: 5,778,832

[45] Date of Patent: Jul. 14, 1998

[54] MODULAR RADIATOR FOR AN ENGINE-GENERATOR SET

[75] Inventors: James L. King, Sheboygan; Randy Scarf, New Holstein, both of Wis.

[73] Assignee: Kohler Co., Kohler, Wis.

[21] Appl. No.: 837,195

[22] Filed: Apr. 14, 1997

[51] Int. Cl.[6] ..... F02B 63/04

[52] U.S. Cl. ..... 123/2; 123/41.49; 165/DIG. 310

[58] Field of Search ..... 123/2, 3, 41.51, 123/41.49; 165/DIG. 310, DIG. 316, 124

[56] References Cited

U.S. PATENT DOCUMENTS

| | | | |
|---|---|---|---|
| 2,124,523 | 7/1938 | Blanton | 123/41.49 |
| 3,347,310 | 10/1967 | Lind et al. | 165/124 |
| 4,164,660 | 8/1979 | Palazzetti | 290/2 |
| 4,180,130 | 12/1979 | Beck et al. | 165/124 |
| 4,202,296 | 5/1980 | Nonnenmann et al. | 123/41.48 |
| 4,548,164 | 10/1985 | Ylonen et al. | 123/2 |
| 4,736,111 | 4/1988 | Linden | 290/2 |
| 4,757,858 | 7/1988 | Miller et al. | 165/41 |
| 5,014,660 | 5/1991 | Westerbeke, Jr. | 123/2 |
| 5,065,814 | 11/1991 | Loeber et al. | 165/41 |
| 5,074,114 | 12/1991 | Meijer et al. | 60/517 |
| 5,074,254 | 12/1991 | Takamatsu | 123/2 |
| 5,172,657 | 12/1992 | Sausner et al. | 123/41.5 |
| 5,433,175 | 7/1995 | Hughes et al. | 123/2 |
| 5,515,816 | 5/1996 | Ball et al. | 123/2 |
| 5,642,702 | 7/1997 | Kouchi et al. | 123/2 |

*Primary Examiner*—David A. Okonsky
*Attorney, Agent, or Firm*—Quarles & Brady

[57] ABSTRACT

An apparatus for generating electricity includes an internal combustion engine having a drive shaft connected to an electrical generator. A radiator, through which coolant from the engine circulates, is formed by a six sided enclosure with radiator cores forming three, four or five of the six sides. The radiator has a tank mounted above and connected to the three radiator cores to serve as a coolant plenum and as a collector for air entrapped in the coolant. A fan is mounted either inside or outside the radiator enclosure, adjacent to one of the six sides, and is driven by the engine drive shaft or an electric motor. A muffler for the engine may be located within radiator enclosure and cooled by air flowing therethrough.

20 Claims, 3 Drawing Sheets

MODULAR RADIATOR FOR AN ENGINE-GENERATOR SET

BACKGROUND OF THE INVENTION

The present invention related to engine-generator sets for generating electricity, and more particularly to radiators for the cooling system of the engine in the set.

Engine-generator sets are commonly used to produce electricity in remote locations and as a backup sources of electricity in the event of a power line failure. Such apparatus comprise an internal combustion engine which drives an electric generator. These devices can range in size from a single cylinder engine driving a generator that produces one kilowatt to large generators producing hundreds of kilowatts and driven by multiple cylinder engines. In the case of larger capacity engine-generator sets, the engine is typically water cooled by means of a radiator.

The larger engine-generators often are shipped overseas and it is desirable that the entire unit is able to fit within a standard maritime overseas shipping container. Engine-generator sets capable of producing approximately 750 kW and more often have a radiator for the cooling system which cannot be left attached to the generator during shipment as the frontal dimensions of the radiator are too large to fit within standard shipping containers. Thus, in order to ship these larger engine-generator sets, the radiator must be left disassembled and attached at the final destination. In addition, radiators for generators larger than 1200 kW do not fit an ISO shipping container either lying on their side or standing up. These radiators must be shipped in an open top ISO container and must be stacked on top od other containers on board a ship.

SUMMARY OF THE INVENTION

A general object of the present invention is to provide a radiator for the cooling system of an engine-generator set which can be left attached and still fit within a standard maritime overseas shipping container.

Another object is to provide a mechanism for collecting entrapped air that otherwise could cause the radiator cores to become air locked.

These and other objects are satisfied by an apparatus for generating electricity which comprises an internal combustion engine that has a drive shaft, a coolant outlet and a coolant inlet. An electrical generator is driven by a connection to the drive shaft of the internal combustion engine. A radiator is formed by a hexahedral enclosure with three radiator cores each forming one of the six sides. The radiator further includes a tank mounted above the three cores and connected so that coolant for the engine flows between the tank and the three cores. The tank is connected to one of the coolant outlet or the coolant inlet, and the three radiator cores are connected to the other of the coolant outlet and the coolant inlet.

A fan is mounted adjacent to one of the six sides of the radiator to force air through the three cores. In different embodiments of the apparatus, the fan may be located inside or outside of the radiator enclosure and may be driven by either the engine drive shaft or an electric motor.

A further aspect of the present invention is to locate the muffler for the engine within the radiator enclosure where the muffler is exposed to high air flow which provides improved cooling.

DETAILED DESCRIPTION OF THE INVENTION

Figure 1:
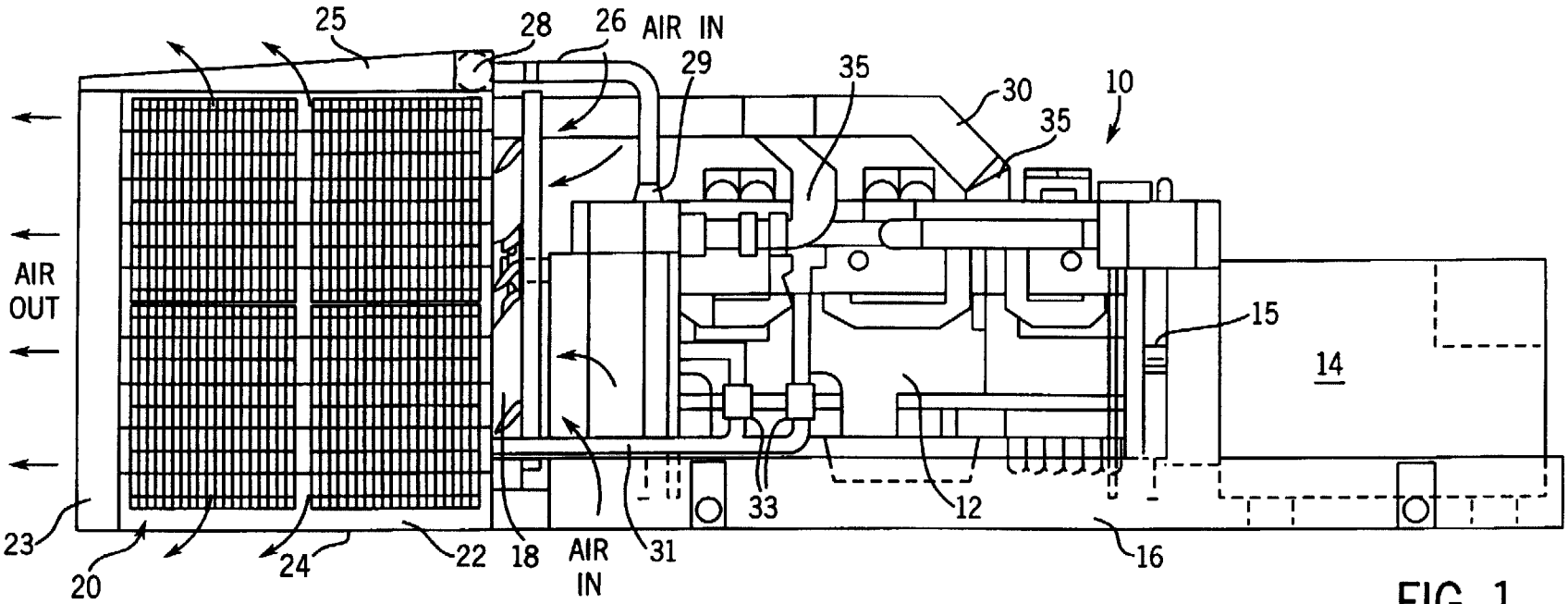
FIG. 1 is a side view of an engine-generator set that incorporates a radiator according to the present invention.
Figure 2:
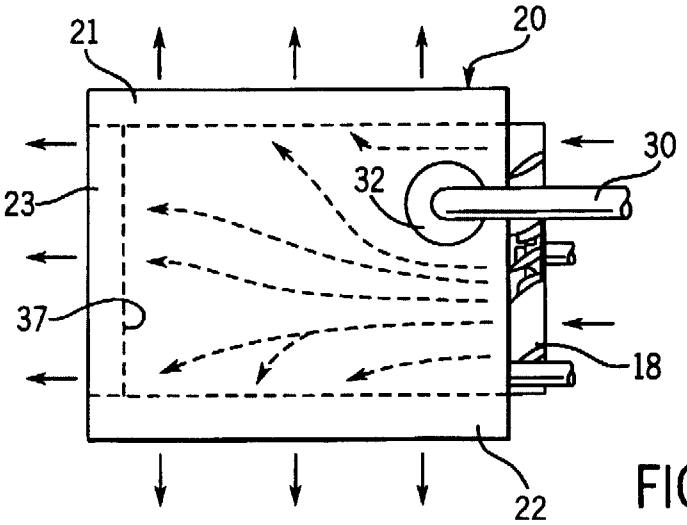
FIG. 2 is a top view of the radiator in FIG. 1.

With initial reference to FIGS. 1 and 2, an engine-generator set 10 comprises a multiple cylinder diesel engine 12 having a drive shaft 15 connected to a generator 14 which produces electricity. The engine 12 and generator 14 are mounted on a metal frame or skid 16 so as to be transportable as a unit. The drive shaft 15 extends through the engine 12 and is coupled to rotate a fan 18 at the end of the engine which is remote from the generator 14.

A radiator 20 is on the opposite side of the fan 18 from the engine 12. The radiator 20 has a hexahedral enclosure with two opposing sides formed by two standard radiator cores 21 and 22 mounted in a spaced apart parallel relationship to each other. A third radiator core 23 forms another side of the enclosure that is remote from the fan and extends between the two side radiator cores 21 and 22. Each radiator core 21–23 is of a conventional design with a series of tubes through which coolant flows and fins attached to the external surfaces of the tubes to radiate heat from the coolant.

Figure 3:
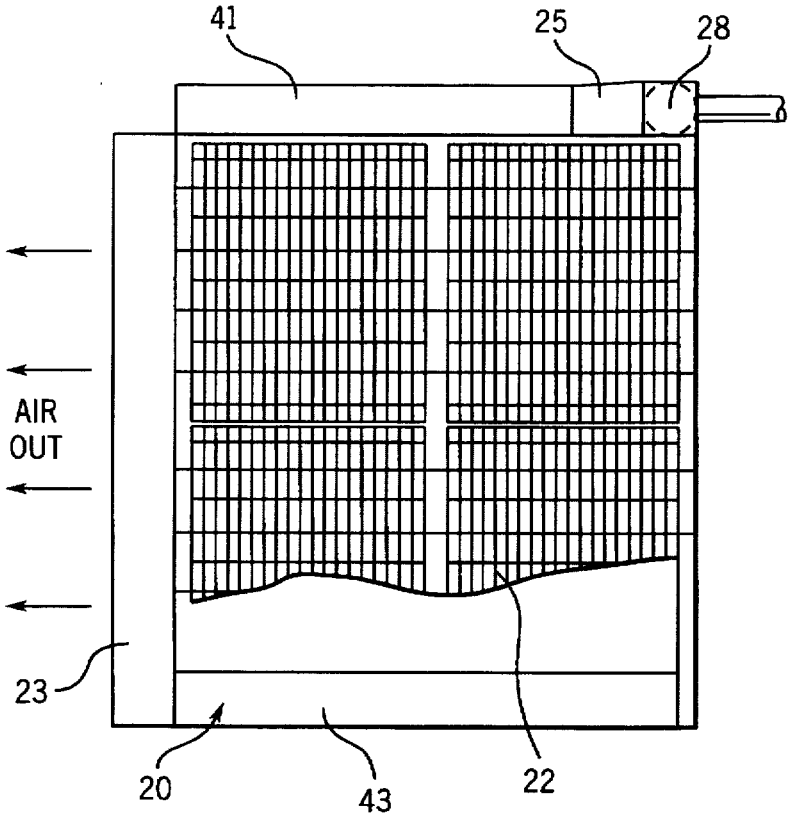
FIG. 3 is a side view of a variation of the radiator with cores on the top and bottom sides.

The bottom side of the enclosure for radiator 20 is closed by a solid metal panel 24, but in the alternative, a fourth radiator core be used when the bottom side is open to air flow. A tank 25 forms the top side of the radiator 20 and has outlets connected to openings in the top edges of the three radiator cores 21–23 so that coolant is able to flow between the tank 25 and the radiator cores. A plenum 28 extends along the engine side of the top tank 25 and is coupled to the coolant inlet 29 of the engine block by a radiator hose 26. Another radiator hose 31 extends from the coolant outlet 33 of the engine 12 to the lower portion of each radiator core 21–23. Alternatively, the tank could be reduced in size so that another radiator core can be mounted across the top of the enclosure. This embodiment is shown in FIG. 3 with additional radiator cores on the top and bottom sides of the enclosure.

Referring again to FIGS. 1 and 2, coolant from the engine flows through hose 31 and upward through each of the radiator cores 21–23. The coolant then is drawn out of the three radiator cores and into the top tank 25 from which the coolant flows through the upper hose 26 back to the engine 12. The placement of a tank 25 at the top of the radiator 20 not only covers the top of the enclosure, but also serves as a collection chamber for air which is entrapped in the coolant system. Without such a collection mechanism this air could cause the radiator cores to become air locked, thereby inhibiting the coolant flow and effective cooling of the engine 12.

When the engine is running, the rotation of fan 18 forces air into the internal chamber 37 of the radiator 20 as shown by the arrows in FIGS. 1 and 2. A cowling may be provided around the fan 18 to direct the air flow. From the internal chamber 37 of the radiator 20, the air flows outward through each of the radiator cores 21–23 at which time the air picks up heat from the fins on the core tubes.

The engine exhaust manifolds 35 are connected to an exhaust pipe 30 which extends into the top portion of the radiator enclosure. The exhaust pipe 30 connects to the top end of a muffler 32 which is mounted vertically within the internal chamber 37 of the radiator 22. The muffler 32 has an outlet at its lower end which communicates with an aperture in the bottom panel 24 of the radiator 20. Thus cooling air forced through the radiator 20 by the fan 18 also passes around the muffler 32 removing heat from the muffler.

Figure 4:
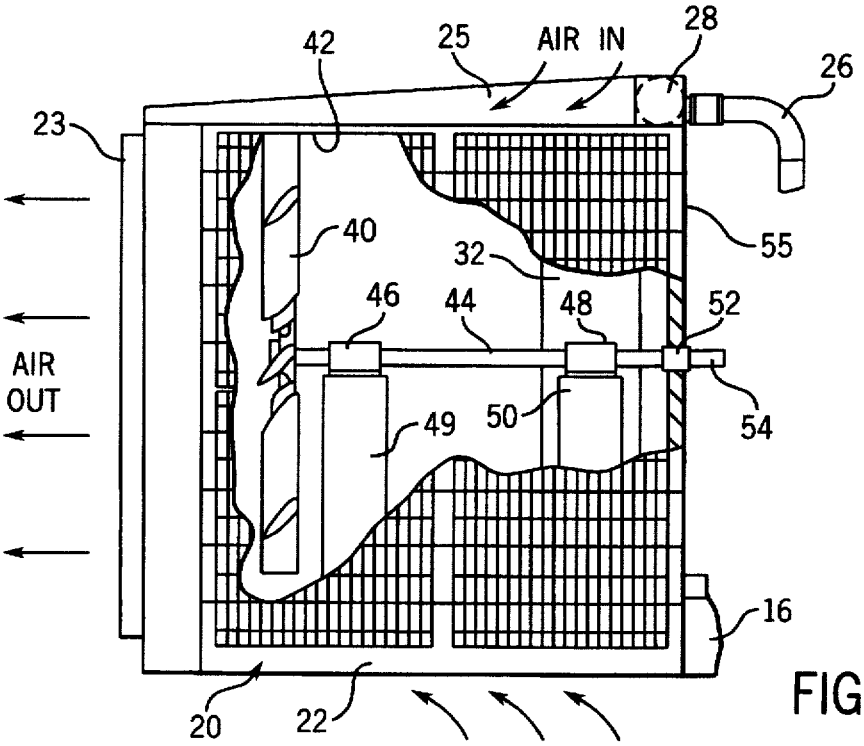
FIG. 4 is a partially cut-away side view of a second embodiment of the radiator.

FIG. 4 shows and alternative arrangement in which the fan 40 is positioned within the internal chamber 42 of the radiator facing the third radiator core 23 (i.e. the plane of fan rotation is substantially parallel to the plane of the third radiator core 23). Specifically, the fan 40 is attached to one end of a fan shaft 44 that is mounted through bearings 46 and 48 on two posts 49 and 50 within the radiator chamber 42. The opposite end of the fan shaft 44 is attached by a coupling 52 to the engine fan shaft 54 which is driven by the drive shaft 15 via a belt (not shown). The coupling 52 may be a flexible type of connector to accommodate slight misalignment of the two shafts 44 and 54.

In this embodiment the radiator's rear side, facing the engine, is closed by a solid panel 55. Thus the rotation of the fan 40 by the engine 12 draws air in through the two side radiator cores 21 and 22 and forces the air out the third radiator core 23. A few small openings may be provided in the rear panel 55 in order to draw some air across the exterior surfaces of the engine 12 and into the radiator 20.

Figure 5:
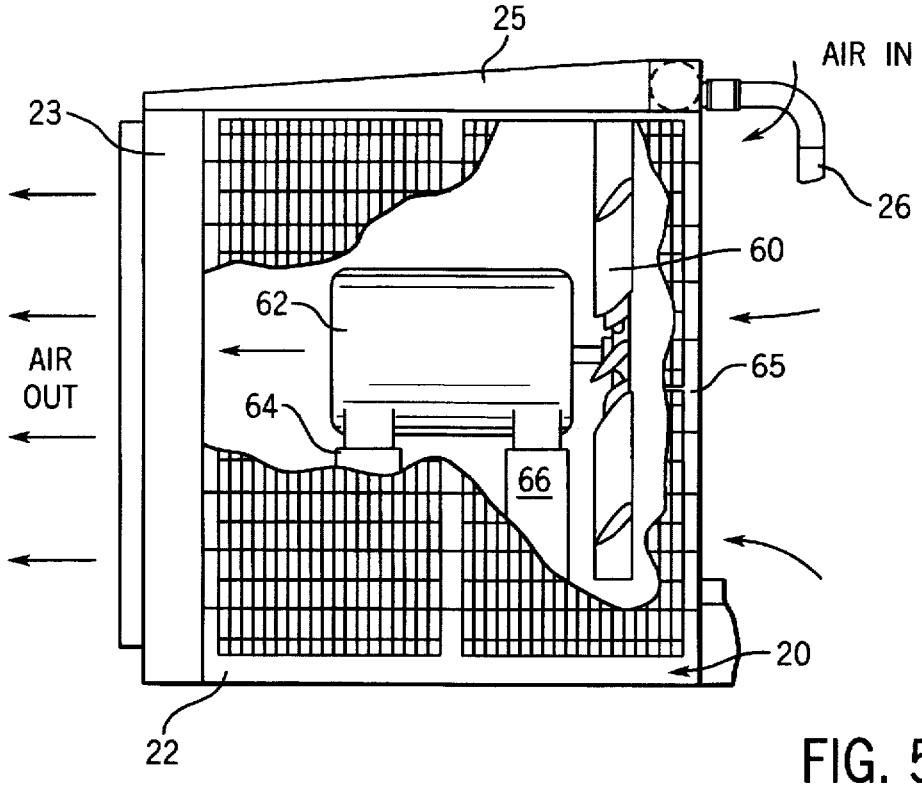
FIG. 5 is a partially cut-away side view of a third embodiment of the radiator.

FIG. 5 illustrates a third embodiment of the present invention in which an electric motor 62 is employed to drive the fan 60. The electric motor 62 is mounted on two posts 64 and 66 within the chamber of the radiator 20. The electric motor is powered by electricity from generator 14 whenever the engine 12 is operating. The rear side 65 of the radiator 20 is open and the fan 60 is located adjacent to and facing the interior of that rear side. The blades of the fan are oriented so as to draw air in through the open rear side 65 and force the air out through the radiator cores 21–23.

As with the previous embodiments, the coolant is passes from the engine 12 and into the radiator through the lower radiator hose 31 into the bottom portions of the radiator cores 21–23. The coolant then flows upward through the three cores 21–23 and into the tank 25 from which the coolant returns to the engine through upper hose 26.

Figure 6:
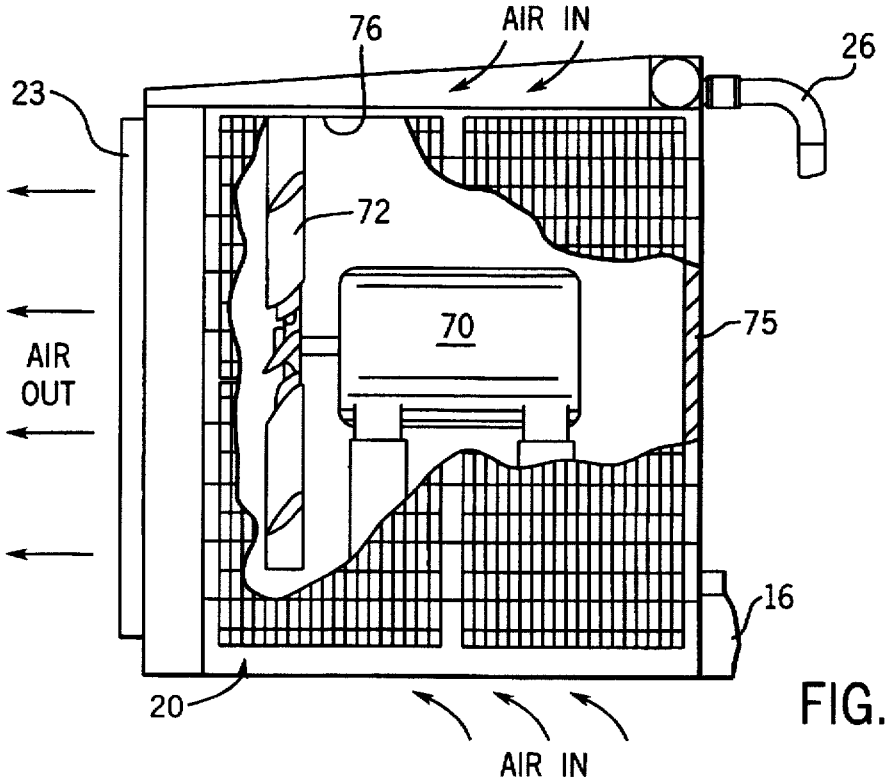
FIG. 6 is a partially cut-away side view of a fourth embodiment of the radiator.

Alternatively, the motor and fan can be mounted in a reverse orientation within the radiator chamber, as shown in FIG. 6. Here the motor 70 has an output shaft directed toward the third, or front, radiator core 23 with the fan 72 positioned facing the inside surface of that radiator core. The motor 70 is powered by electricity from the generator 14 and thus runs whenever the engine 12 is operating. In this case the rear, or engine, side 75 of the radiator 20 is closed by a solid panel to prevent air entry. Therefore, air is drawn into the radiator enclosure through the two side cores 21 and 22 and is forced out by the fan 72 through the third radiator core 23.

We claim:

1. An apparatus for generating electricity comprising:

an internal combustion engine having a drive shaft, a coolant outlet, a coolant inlet, and a combustion exhaust outlet;

an electrical generator driven by a connection to the drive shaft of the internal combustion engine;

a radiator having the form of a hexahedral enclosure and having three cores each forming one side of the enclosure, the radiator further having a tank mounted above the three cores and connected so that coolant for the engine flows between the tank and the three cores, the tank being connected to one of the coolant outlet and the coolant inlet and the three tanks being connected to the other of the coolant outlet and the coolant inlet; and a fan mounted adjacent to one side of the enclosure for forcing air through the three cores.

2. The apparatus as recited in claim 1 wherein the fan is positioned between the radiator and the engine.

3. The apparatus as recited in claim 1 wherein the fan is positioned within the enclosure of the radiator.

4. The apparatus as recited in claim 1 wherein the fan is coupled to the drive shaft of the engine.

5. The apparatus as recited in claim 4 wherein the fan is positioned between the radiator and the engine.

6. The apparatus as recited in claim 5 wherein the fan forces air through an opening in one side of the enclosure that is opposite to one of the three cores.

7. The apparatus as recited in claim 4 wherein the fan is within the enclosure of the radiator.

8. The apparatus as recited in claim 4 wherein the fan is positioned adjacent to and facing one of the three cores.

9. The apparatus as recited in claim 1 further comprising an electric motor within the enclosure of the radiator and having a shaft to which the fan is coupled.

10. The apparatus as recited in claim 9 wherein the fan is positioned adjacent to and facing one of the three cores.

11. The apparatus as recited in claim 9 wherein the fan faces an opening in one side of the enclosure that is opposite to one of the three cores.

12. The apparatus as recited in claim 1 further comprising a muffler within the enclosure of the radiator and connected to the combustion exhaust outlet of the engine.

13. The apparatus as recited in claim 1 wherein said radiator further comprises another core which forms yet another side of the enclosure.

14. The apparatus as recited in claim 1 wherein said radiator further comprises another two cores each of which form another side of the enclosure.

15. An apparatus for generating electricity comprising:

an internal combustion engine having a drive shaft, a coolant outlet, a coolant inlet, and an exhaust outlet;

an electrical generator driven by a connection to the drive shaft of the internal combustion engine;

a radiator formed by an enclosure with six sides and having three cores, each forming one of the six sides and being connected to the coolant outlet and the coolant inlet;

a fan mounted adjacent to one of the six sides of the enclosure for forcing air through the three cores; and a muffler within the enclosure of the radiator and connected to the exhaust outlet of the engine.

16. The apparatus as recited in claim 15 further comprising a tank mounted above the three cores and connected so that coolant for the engine flows between the tank and the three cores, the tank being connected to the coolant inlet.

17. The apparatus as recited in claim 15 wherein the fan is positioned between the radiator and the engine and is driven by the drive shaft.

18. The apparatus as recited in claim 15 wherein the fan is positioned within the enclosure of the radiator.

19. The apparatus as recited in claim 18 wherein the fan is driven by and coupled to the drive shaft of the engine.

20. The apparatus as recited in claim 18 wherein the fan is driven by and coupled to an electric motor.

* * * * *